US008368613B2

(12) United States Patent
Hornung

(10) Patent No.: US 8,368,613 B2
(45) Date of Patent: Feb. 5, 2013

(54) WIRELESS COMMUNICATION SYSTEM

(75) Inventor: Craig Warren Hornung, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 457 days.

(21) Appl. No.: 12/776,790

(22) Filed: May 10, 2010

(65) Prior Publication Data

US 2011/0273339 A1 Nov. 10, 2011

(51) Int. Cl.
*H01Q 1/50* (2006.01)

(52) U.S. Cl. ..... 343/906; 343/702

(58) Field of Classification Search ..... 343/906, 343/702; 439/63, 581, 98
See application file for complete search history.

(56) References Cited

U.S. PATENT DOCUMENTS

| | | | | |
|---|---|---|---|---|
| 5,738,529 | A * | 4/1998 | Wedell et al. | 439/63 |
| 7,198,509 | B2 | 4/2007 | Takasu | |
| 7,782,273 | B2 * | 8/2010 | Morikawa | 343/906 |
| 8,242,969 | B2 * | 8/2012 | Lutman et al. | 343/906 |
| 2008/0143635 | A1 * | 6/2008 | Lin et al. | 343/906 |
| 2008/0246691 | A1 * | 10/2008 | Yoshie | 343/906 |

* cited by examiner

*Primary Examiner* — Dieu H Duong

(57) ABSTRACT

An antenna includes a flexible film substrate having a signal element and a ground element. A signal contact is mounted to the flexible film substrate. The signal contact is electrically connected to the signal element by a compression connection and the signal contact includes a wire termination configured to be terminated to a center conductor of a coaxial cable. A ground contact is mounted to the flexible film substrate. The ground contact is electrically connected to the ground element by a compression connection and includes a wire termination configured to be terminated to a cable braid of the coaxial cable.

20 Claims, 5 Drawing Sheets

WIRELESS COMMUNICATION SYSTEM

BACKGROUND OF THE INVENTION

The subject matter herein relates generally to wireless communication systems, and more particularly, to antennas for wireless communication systems.

Wireless communication systems are in use and have a wide variety of applications including voice communication, data communication, and the like. For example, wireless communication systems may be used to communicate between cell phone towers and mobile phone. Wireless communication systems may be used to transfer data wirelessly between a router and a computer. Other examples of wireless communication systems include GPS systems, radio systems, PDAs, cell phones, data networks such as a LAN, and the like. Wireless communication systems typically include an antenna coupled to a wireless device by a cable. The wireless device includes a transmitter and/or a receiver. Size constraints due to miniaturization demand ultra small coaxial interconnects. In systems today, the coaxial cable is connected to the antenna using solder or a conductive epoxy connection. In other systems, a small coaxial receptacle is soldered to the antenna and a plug is crimped to the wire which is inserted into the receptacle. Both systems utilize solder or epoxy at some interface between the coaxial cable and the antenna. The amount of material between the coaxial cable and the antenna changes the electrical properties of the interface, thereby changing the RF performance of the system. As transmission speeds increase, the negative impact on the electrical properties of the interface is exaggerated.

Some wireless communication systems desire the use of flex circuits within the antenna. Electrical connections to flex circuits in antennas have heretofore proven difficult. Additionally, with miniaturization, connection to flexible circuits has proven difficult. For example, the flexible base material of the flex circuit may be damaged by the high solder melt temperatures required for solder attachment of the coaxial cable to the antenna. Some flexible materials such as KAPTON®, are known that can withstand the high temperature of solder, however, such materials are costly.

A need remains for a wireless communication system that utilizes a flex circuit as an antenna. A need remains for an attachment method for connecting a coaxial cable to flexible circuit used within an antenna.

BRIEF DESCRIPTION OF THE INVENTION

In one embodiment, an antenna is provided that includes a flexible film substrate having a signal element and a ground element. A signal contact is mounted to the flexible film substrate. The signal contact is electrically connected to the signal element by a compression connection and the signal contact includes a wire termination configured to be terminated to a center conductor of a coaxial cable. A ground contact is mounted to the flexible film substrate. The ground contact is electrically connected to the ground element by a compression connection and includes a wire termination configured to be terminated to a cable braid of the coaxial cable.

In another embodiment, an antenna is provided including flexible film substrate having first and second surfaces. The flexible film substrate has a signal element and a ground element on the first surface. A signal contact having a base is mounted to the first surface of the flexible film substrate in electrical connection with the signal element. The signal contact has a mounting element extending from the base that engages the second surface such that the flexible film substrate is captured between the mounting element and the base of the signal contact. The signal contact has a wire termination configured to be terminated to a center conductor of a coaxial cable. A ground contact having a base is mounted to the first surface of the flexible film substrate in electrical connection with the ground element. The ground contact has a mounting element extending from the base that engages the second surface such that the flexible film substrate is captured between the mounting element and the base of the ground contact. The ground contact has a wire termination configured to be terminated to a cable braid of the coaxial cable.

In a further embodiment, a wireless communication system is provided including a coaxial cable having a center conductor, a dielectric surrounding the center conductor, a cable braid surrounding the dielectric and a jacket surrounding the cable braid. The wireless communication system also includes an antenna having a flexible film substrate with a signal element and ground element. The antenna also includes a signal contact mounted to the flexible film substrate, which is electrically connected to the signal element by a compression connection. The signal contact has a wire termination configured to be terminated to a center conductor of the coaxial cable. The antenna also includes a ground contact mounted to the flexible film substrate that is electrically connected to the ground element by a compression connection. The ground contact has a wire termination configured to be terminated to a cable braid of a coaxial cable.

DETAILED DESCRIPTION OF THE INVENTION

Figure 1:
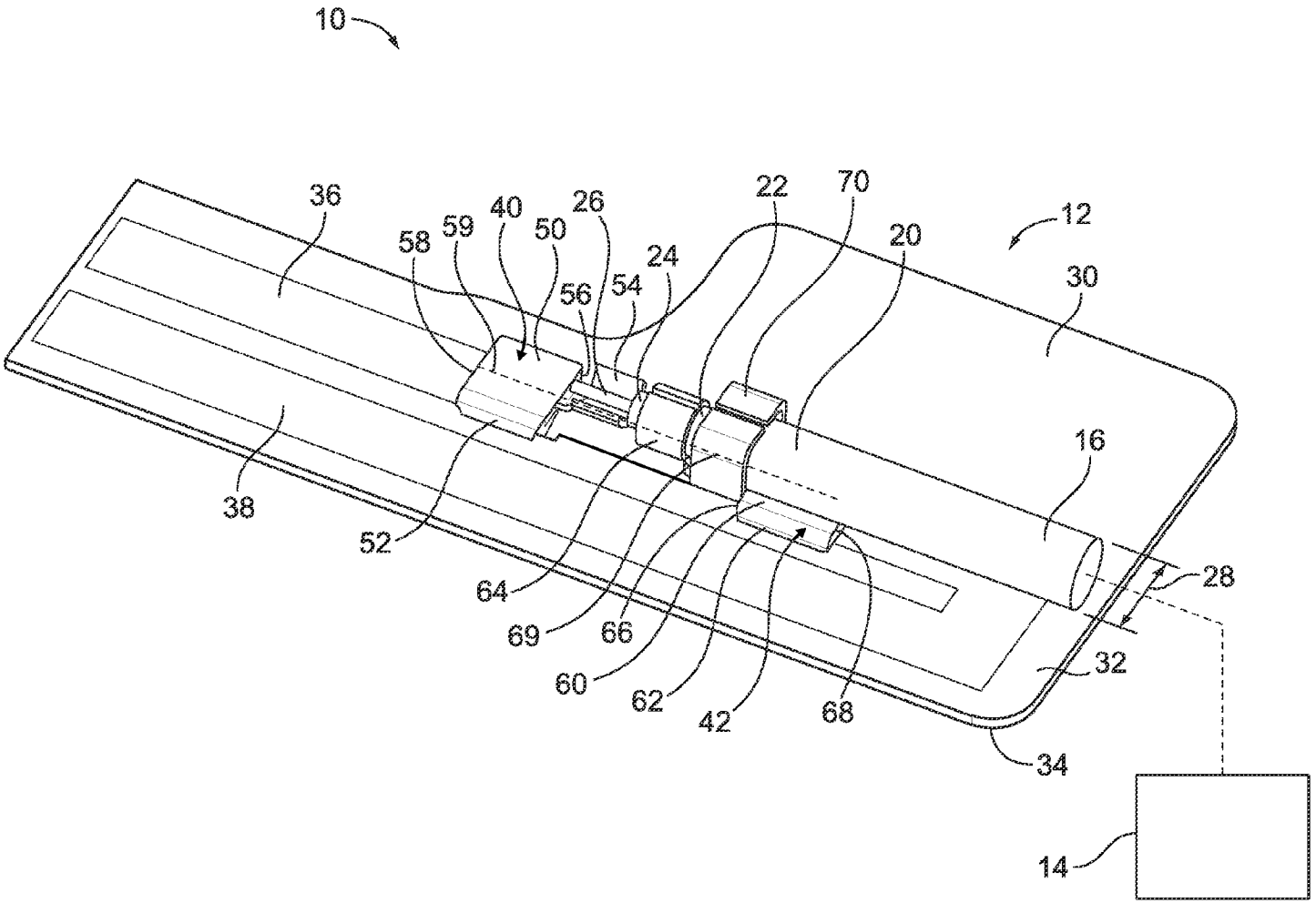
FIG. 1 is a top perspective view of a wireless communication system formed in accordance with an exemplary embodiment.

FIG. 1 illustrates a wireless communication system 10 formed in accordance with an exemplary embodiment. The wireless communication system 10 includes an antenna 12 connected to a wireless device 14 by a cable 16. The wireless device 14 may be any type of wireless device, such as a mobile antenna, a GPS, a radio system, a PDA, a cellular handset, or other type of wireless communication systems, such as a LAN. The wireless device 14 is illustrated in FIG. 1 schematically, and may include any structural features depending on the particular application. The coaxial cable 16 connecting the wireless device 14 and the antenna 12 may have any length.

The cable 16 is a coaxial cable having an outer jacket 20, a cable braid 22, a dielectric 24 and a center conductor 26. The dielectric 24 surrounds the center conductor 26 and isolates the center conductor 26 from the cable braid 22. The cable braid 22 circumferentially surrounds the dielectric 24. The outer jacket 20 circumferentially surrounds the cable braid 22 and defines the outer surface of the cable 16. The cable 16 has a diameter 28 defined by the outer jacket 20. In an exemplary embodiment, the diameter 28 is extremely small. For example, the diameter 28 may be less than 1 mm. In an exemplary embodiment, the outer diameter 28 may be 0.030 inch. Other diameters are possible in alternative embodiments.

The antenna 12 includes a flexible film substrate 30 having a first surface 32 and a second surface 34 opposite the first surface 32. The flexible film substrate 30 has a signal element 36 and a ground element 38 on the first surface 32. The signal and ground elements 36, 38 may be represented by conductors or traces routed along the first surface 32 of the flexible film substrate 30. The positioning of the signal and ground elements 36, 38 along the first surface 32 may be selected to control electrical characteristics and properties of the antenna 12. Similarly, the lengths and widths of the signal and ground elements 36, 38 may be selected to control the electrical characteristics of the antenna 12. The spacing between the signal and ground elements 36, 38 may be selected to control electrical characteristics of the antenna 12. The overall size, shape, and thickness of the flexible film substrate 30 may also be selected to control the electrical characteristics of the antenna 12.

The flexible film substrate 30 may be any type of flexible substrate. The flexible film substrate 30 may be manufactured from a plastic material, such as a polyimide material, a PEEK material, a polyester material, a polyethylene terephthalate (PET) material, and the like, a paper material, or any other suitable material for a flexible film substrate. The signal and ground elements 36, 38 may be deposited on the first surface 32, such as by a screen printing process, an inkjet process, a gravure process, and the like. As such, in an exemplary embodiment, the flexible film substrate 30 constitutes a flexible printed circuit. In an alternative embodiment, flexible foil circuits may be created by laminating thin copper strips between layers of flexible material. The flexible film substrate 30 may be configured to flex during its normal use, such as by folding or bending the flexible film substrate 30 to fit within a particular space or area of the wireless device 14.

The antenna 12 includes a signal contact 40 and ground contact 42. The signal contact 40 is mounted to the flexible film substrate 30 and is electrically connected to the signal element 36. The ground contact 42 is mounted to the flexible film substrate 30 and is electrically connected to the ground element 38. In an exemplary embodiment, the signal contact 40 and ground contact 42 are mounted to the flexible film substrate 30 without the use of solder or epoxy. The signal contact 40 and ground contact 42 are mechanically connected to the flexible film substrate 30. The signal contact 40 and ground contact 42 may be connected to the signal element 36 and ground element 38, respectively, by compression connections, wherein the signal and ground contacts 40, 42 are pressed against the signal and ground elements 36, 38 in direct electrical contact with the signal and ground elements 36, 38, respectively.

The signal contact 40 includes a base 50 and mounting elements 52 used to secure the signal contact 40 to the flexible film substrate 30. The base 50 is electrically connected to the signal element 36. In an exemplary embodiment, as will be described in further detail below, the mounting elements 52 mechanically secure the signal contact 40 to the flexible film substrate 30. For example, the mounting elements 52 may pierce through the flexible film substrate 30 and wrap around the second surface 34 of the flexible film substrate 30. Other types of mechanical fastening means or processes may be used in other embodiments to mechanically secure the signal contact 40 to the flexible film substrate 30.

The signal contact 40 includes a wire termination 54 extending from the base 50. The wire termination 54 is configured to be terminated to the center conductor 26 of the cable 16. In the illustrated embodiment, the wire termination 54 constitutes a crimp type connection where the wire termination 54 is crimped to the center conductor 26. The wire termination 54 extends from a first end 56 of the base 50 which is opposite to a second end 58 of the base 50. The signal contact 40 extends along a longitudinal axis 59, with the wire termination 54 extending from the base 50 and also extending along the longitudinal axis 59. The longitudinal axis 59 is parallel to the signal element 36. FIG. 1 illustrates the wire termination 54 in an unterminated state. Other types of wire terminations are possible in alternative embodiments, including insulation displacement terminations.

The ground contact 42 includes a base 60 and mounting elements 62 used to secure the ground contact 42 to the flexible film substrate 30. The base 60 is electrically connected to the ground element 38. In an exemplary embodiment, as will be described in further detail below, the mounting elements 62 mechanically secure the ground contact 42 to the flexible film substrate 30. For example, the mounting elements 62 may pierce through the flexible film substrate 30 and wrap around the second surface 34 of the flexible film substrate 30. Other types of mechanical fastening means or processes may be used in other embodiments to mechanically secure the ground contact 42 to the flexible film substrate 30.

The ground contact 42 includes a wire termination 64 extending from the base 60. The wire termination 64 is configured to be terminated to the cable braid 22 of the cable 16. In the illustrated embodiment, the wire termination 64 constitutes a crimp type connection where the wire termination 64 is crimped to the cable braid 22. The wire termination 64 extends from a first end 66 of the base 60 which is opposite to a second end 68 of the base 60. The ground contact 42 extends along a longitudinal axis 69, with the wire termination 64 extending from the base 60 and also extending along the longitudinal axis 69. The longitudinal axis 69 is parallel to the ground element 38. In an exemplary embodiment, the longitudinal axis 69 of the ground contact 42 is aligned with the longitudinal axis 59 of the signal contact 40. As such, the cable 16 may be easily loaded into the wire termination 54, the wire termination 64 and a strain relief element 70 of the ground contact 42. FIG. 1 illustrates the wire termination 64 in a terminated state. Other types of wire terminations are possible in alternative embodiments, including insulation displacement terminations.

The ground contact 42 includes the strain relief element 70, which is configured to engage the jacket 20 of the cable 16. In the illustrated embodiment, the strain relief element 70 represents a crimp type connection for crimping to the jacket 20. Other types of strain relief elements may be used in alternative embodiments to engage the jacket 20 and provide strain relief for the cable 16. The strain relief element 70 helps to maintain a relative position of the jacket 20 with respect to the inner portions of the cable 16, such as the center conductor 26 and the cable braid 22.

Figure 2:
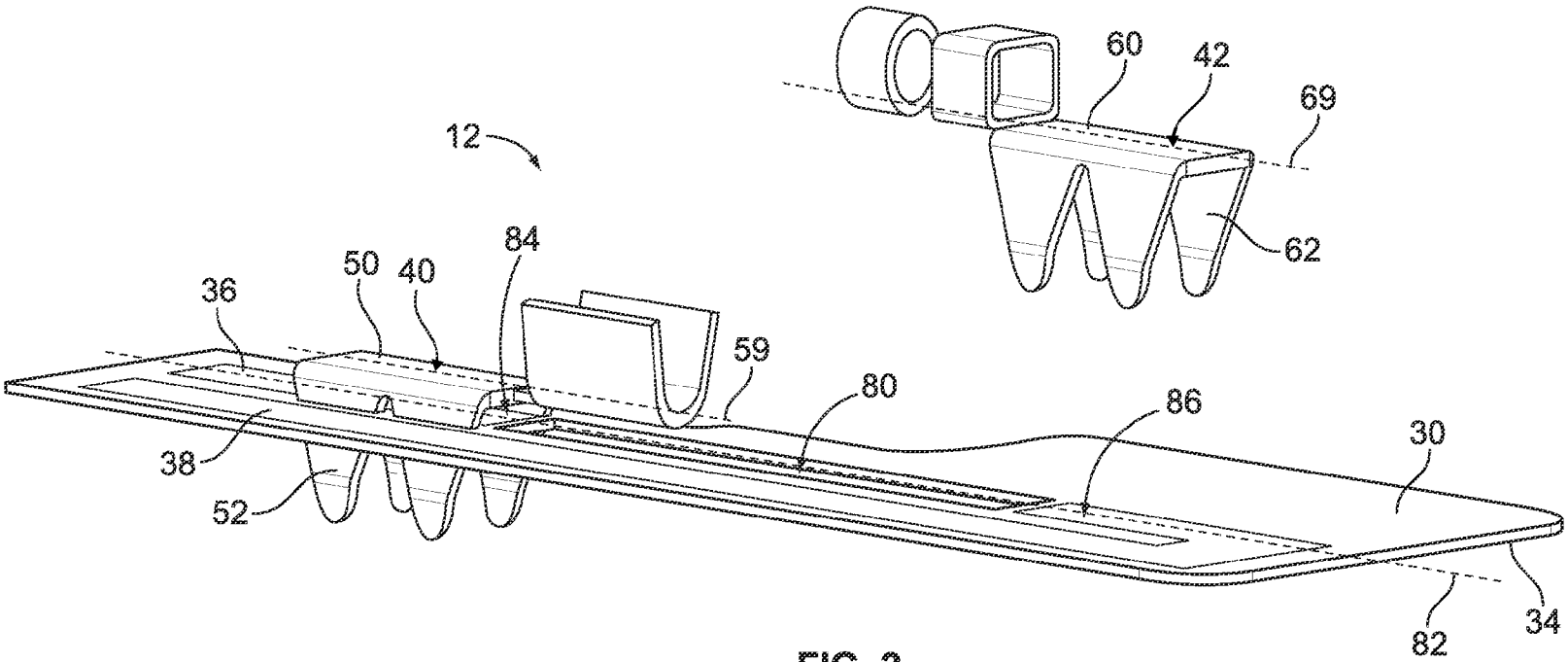
FIG. 2 is an exploded view of an antenna for the wireless communication system shown in FIG. 1.

FIG. 2 is an exploded view of the antenna 12. The flexible film substrate 30 includes an opening 80 therethrough. The opening 80 is aligned with the signal and ground elements 36, 38. In an exemplary embodiment, the signal and ground elements 36, 38 are aligned with one another along a common axis 82. The opening 80 is also aligned with the axis 82. The axis 82 is parallel to the longitudinal axes 59, 69 of the signal and ground contacts 40, 42.

The signal element 36 includes a mounting portion 84 at an end of the signal element 36. The mounting portion 84 is positioned proximate to the opening 80. The ground element 38 includes a mounting portion 86 at an end of the ground element 38. The mounting portion 86 is positioned proximate to the opening 80.

The signal contact 40 is configured to be mounted to the flexible film substrate 30 such that the signal contact 40 engages the mounting portion 84. The ground contact 42 is configured to be mounted to the flexible film substrate 30 such that the ground contact 42 engages the mounting portion 86. The mounting portions 84, 86, and thus the signal and ground contacts 40, 42 are aligned with one another along the axis 82, such that the signal contact 40 and the ground contact 42 are configured to receive the cable 16 (shown in FIG. 1).

In the illustrated embodiment, the signal contact 40 is illustrated partially mounted to the flexible film substrate 30. The signal contact 40 is not fully seated on the flexible film substrate 30. The ground contact 42 is illustrated in an unmounted position vertically above the flexible film substrate 30. The ground contact 42 is aligned over the ground element 38 of the flexible film substrate 30. During assembly, the signal and ground contacts 40, 42 are loaded on to the flexible film substrate 30 and secured thereto. For example, the mounting elements 52, 62 are used to secure the signal contact 40 and ground contact 42, respectively, to the flexible film substrate 30.

In the illustrated embodiment, the mounting elements 52 constitute barbs that are configured to pierce through the flexible film substrate 30. FIG. 2 illustrates the signal contact 40 partially mounted to the flexible film substrate 30. During assembly, the mounting elements 52 are loaded through the flexible film substrate 30, and the signal contact 40 is pressed down on to the flexible film substrate 30 until the base 50 engages the signal element 36. The mounting elements 52 may have points at distal ends thereof that allow the mounting elements 52 to pierce the flexible film substrate 30. Alternatively, the flexible film substrate 30 may have slots or openings formed therethrough that receive the mounting elements 52. When loaded onto the flexible film substrate 30, the mounting elements 52 are configured to engage the second surface 34 of the flexible film substrate 30. The engagement of the mounting elements 52 to the second surface 34 retains the signal contact 40 on the flexible film substrate 30.

In an exemplary embodiment, the mounting elements 52 may be folded or wrapped underneath the signal element 36 along the second surface 34. For example, the mounting elements 52 may be bent inward, such as in a manner similar to a staple, to secure the signal contact 40 to the flexible film substrate 30. In an alternative embodiment, one or both of the mounting elements 52 may be flared outward rather than bent inward to secure the signal contact 40 to the flexible film substrate 30. Alternatively, the mounting elements 62 may be rolled under the flexible film substrate 30 or otherwise manipulated such that the mounting element 62 becomes enlarged beneath the flexible film substrate to resist backing out of the mounting elements from the slots so that the relative position of the ground contact 42 may be stabilized with respect to the flexible film substrate.

Any number of mounting elements 52 may be provided. In the illustrated embodiment, four mounting elements 52 are provided, with two mounting elements 52 along one side of the base 50 and two mounting elements 52 along the opposite side base 50. The mounting elements 52 may be aligned with one another across the base 50 such that the mounting elements 52 engage one another when the mounting elements 52 are folded inward. Alternatively, the mounting elements 52 may be staggered so that the mounting elements are not aligned with one another when the mounting elements 52 are bent inward.

The mounting elements 62 may be substantially similar to the mounting elements 52. For example, the mounting elements 62 may constitute barbs that are configured to pierce through the flexible film substrate 30. FIG. 2 illustrates the ground contact 42 poised for mounting to the flexible film substrate 30. During assembly, the mounting elements 62 are loaded through the flexible film substrate 30, and the ground contact 42 is pressed down onto the flexible film substrate 30 until the base 60 engages the ground element 38. The mounting elements 62 may have points at distal ends thereof that allow the mounting elements 62 to pierce the flexible film substrate 30. Alternatively, the flexible film substrate 30 may have slots or openings formed therethrough that receive the mounting elements 62. The mounting elements 62 are configured to engage the second surface 34 of the flexible film substrate 30 to retain the ground contact 42 on the flexible film substrate 30. In an exemplary embodiment, the mounting elements 62 may be folded or wrapped underneath the ground element 38 along the second surface 34. Alternatively, the mounting elements 62 may be rolled under the flexible film substrate 30 or otherwise manipulated such that the mounting element 62 becomes enlarged beneath the flexible film substrate to resist backing out of the mounting elements from the slots so that the relative position of the ground contact 42 may be stabilized with respect to the flexible film substrate.

Figure 3:
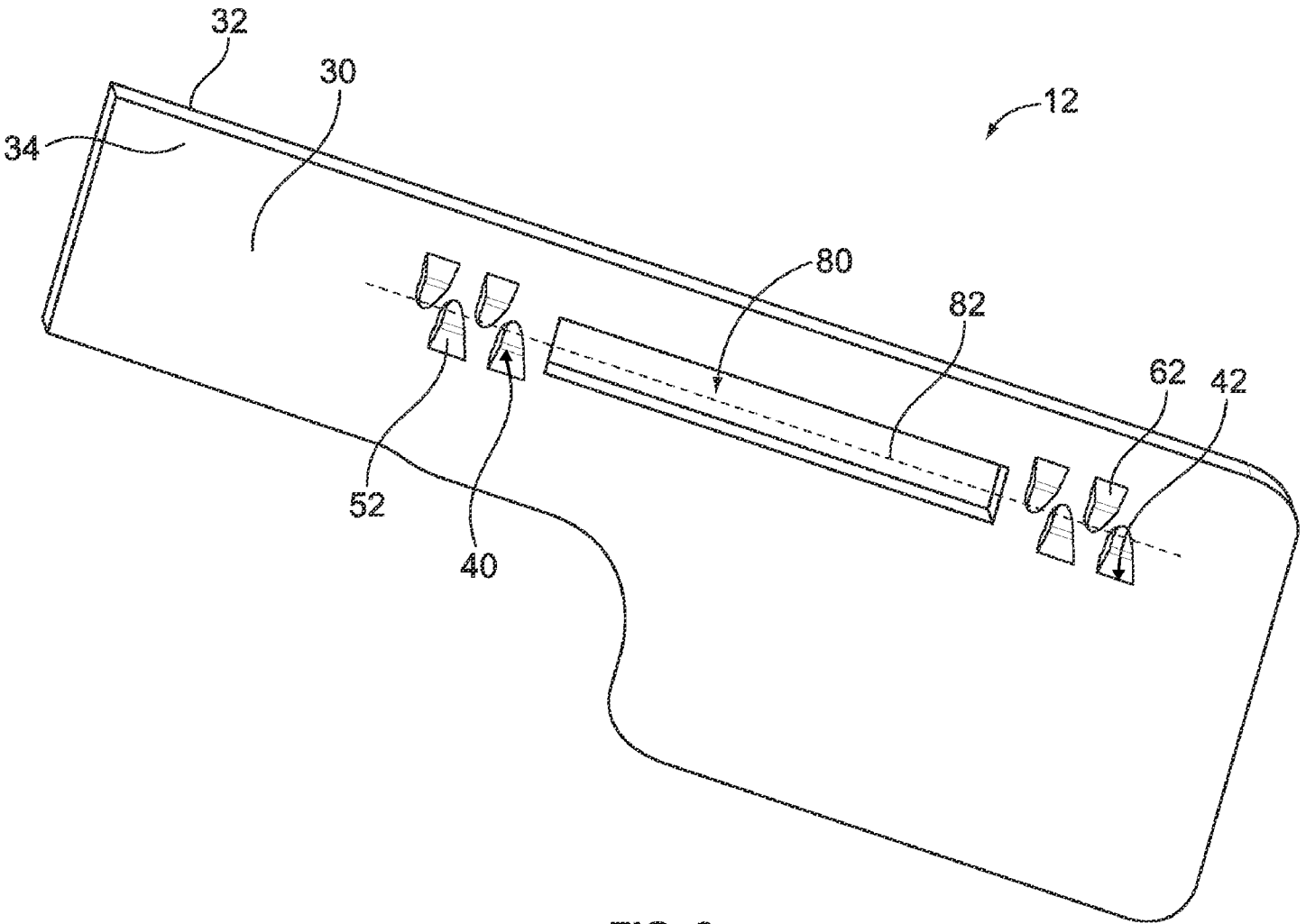
FIG. 3 is a bottom perspective view of the antenna shown in FIG. 2.

FIG. 3 is a bottom perspective view of the antenna 12. The mounting elements 52 of the signal contact 40 are illustrated along the second surface 34 of the flexible film substrate 30. Similarly, the mounting elements 62 of the ground contact 42 are illustrated along the second surface 34 of the flexible film substrate 30. The mounting elements 52, 62 extend through the flexible film substrate 30 and are bent inward on top of one another. The mounting elements 52, 62 may be crimped into the folded arrangement illustrated in FIG. 3. Other folding operations or processes may be used in alternative embodiments to secure the mounting elements 52, 62 to the second surface 34 of the flexible film substrate 30.

In an exemplary embodiment, wrapping the mounting elements 52, 62 under the second surface 34 forces the mounting elements 52, 62 against the second surface 34 and/or forces the corresponding bases 50, 60 (shown in FIG. 2) against the first surface 32 and the signal and ground elements 36, 38, respectively. The mounting elements 52, 62 may also force the flexible film substrate 30 against the bases 50, 60 which may cause the signal element 36 and the ground element 38 to be pressed against the bases 50, 60 of the signal contact 40 and the ground contact 42, respectively. In an exemplary embodiment, the flexible film substrate 30 may be at least partially compressed between the mounting elements 52, 62 and the bases 50, 60, respectively. FIG. 3 also illustrates the opening 80 extending through the flexible film substrate 30. The mounting elements 52, 62 are aligned with the opening 80 along the axis 82.

Figure 4:
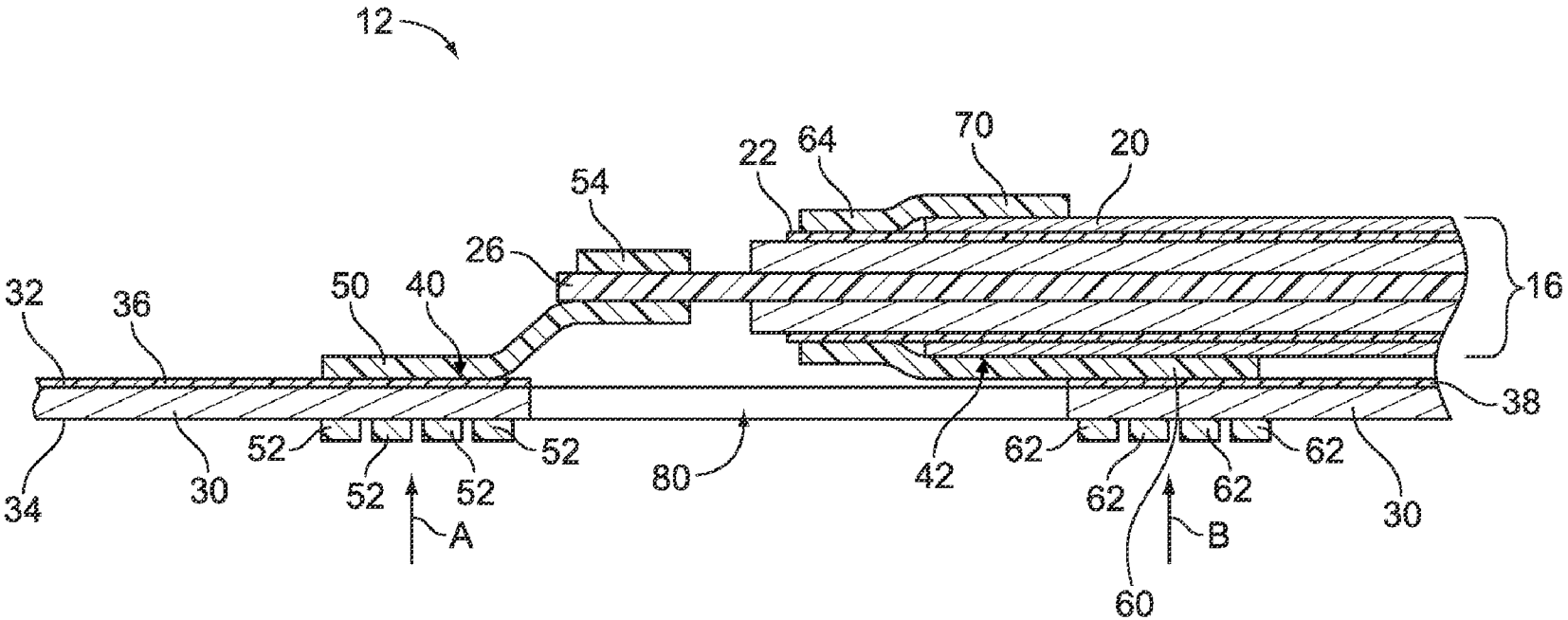
FIG. 4 is a cross sectional view of the antenna shown in FIG. 2.

FIG. 4 is a cross-sectional view of a portion of the antenna 12. FIG. 4 illustrates the flexible film substrate 30 with the signal and ground elements 36, 38 along the first surface 32. FIG. 4 also illustrates the first signal contact 40 mounted to the flexible film substrate 30 such that the signal contact 40 engages the signal element 36. Similarly, the ground contact 42 is mounted to the flexible film substrate 30 such that the ground contact 42 engages the ground element 38.

The wire termination 54 of the signal contact 40 is terminated to the center conductor 26. The wire termination 64 of the ground contact 42 is terminated to the cable braid 22 of the cable 16. The strain relief element 70 of the ground contact 42 is terminated to the jacket 20 of the cable 16.

The opening 80 is positioned vertically below the wire termination 54, the wire termination 64 and the strain relief element 70. In an exemplary embodiment, during assembly, tooling extends through the opening 80 to crimp the wire termination 54 to the center conductor 26, to crimp the wire termination 64 to the cable braid 22 and to crimp the strain relief element 70 to the jacket 20. For example, a crimping portion of, corresponding dies are loaded through the opening 80 to engage the signal contact 40 and the ground contact 42. The opening 80 provides access to the signal contact 40 and the ground contact 42 for termination to the cable 16. The wire terminations 54, 64 are generally aligned with one another to receive the cable 16. The wire terminations 54, 64 are positioned proximate to one another, which may reduce an overall length of the cable 16 and/or affect electrical characteristics of the connection.

During assembly, when the mounting elements 52 are secured to the flexible film substrate 30, a force is applied on the mounting elements 52 in an upward direction, shown by the arrow A. Pressing of the mounting elements 52 against the second surface 34 of the flexible film substrate 30 generally compresses the signal element 36 against the signal contact 40. For example, the signal element 36 is pressed against the base 50 to ensure good electrical contact between the base 50 and the signal element 36. When assembled, the flexible film substrate 30 is captured between the base 50 and the mounting elements 52. The flexible film substrate 30 may be at least partially deflected or flexed inward when the mounting elements 52 are pressed closed. As such, a direct electrical connection is provided between the signal contact 40 and signal element 36, without the need for solder or epoxy. The signal contact 40 is mechanically self-secured to the flexible film substrate 30. No additional element or component is needed to make electrical or mechanical connection between the signal contact 40 and the signal element 36.

During assembly, when the mounting elements 62 are secured to the flexible film substrate 30, a force is applied on the mounting elements 62 in an upward direction, shown by the arrow B. Pressing of the mounting elements 62 against the second surface 34 of the flexible film substrate 30 generally compresses the ground element 38 against the ground contact 42. For example, the ground element 38 is pressed against the base 60 to ensure good electrical contact between the base 60 and the ground element 38. When assembled, the flexible film substrate 30 is captured between the base 60 and the mounting elements 62. The flexible film substrate 30 may be at least partially deflected or flexed inward when the mounting elements 62 are pressed closed. As such, a direct electrical connection is provided between the ground contact 42 and ground element 38, without the need for solder or epoxy. The ground contact 42 is mechanically self-secured to the flexible film substrate 30. No additional element or component is needed to make electrical or mechanical connection between the ground contact 42 and ground element 38.

Figure 5:
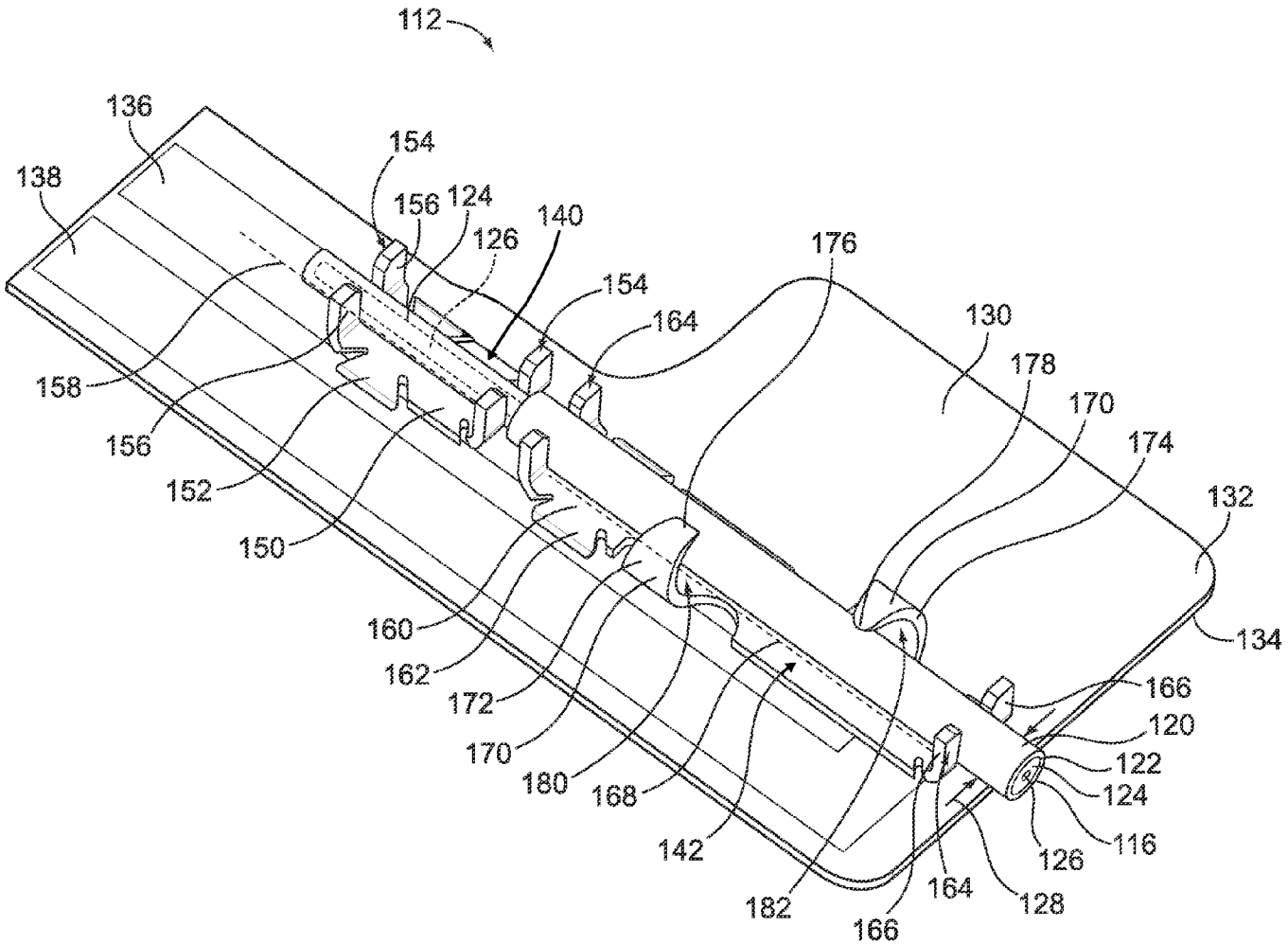
FIG. 5 is a top perspective view of an alternative antenna for the wireless communication system.

FIG. 5 is a top perspective view an alternative antenna 112. The antenna 112 is configured to be connected to a wireless device, such as the wireless device 14 (shown in FIG. 1) by a cable 116. The cable 116 is a coaxial cable having an outer jacket 120, a cable braid 122, a dielectric 124 and a center conductor 126 (shown in phantom). The dielectric 124 surrounds the center conductor 126 and isolates the center conductor 126 from the cable braid 122. The cable braid 122 circumferentially surrounds the dielectric 124. The outer jacket 120 circumferentially surrounds the cable braid 122 and defines, the outer surface of the cable 116. The cable 116 has a diameter 128 defined by the outer jacket 120.

The antenna 112 includes a flexible film substrate 130 having a first surface 132 and a second surface 134 opposite the first surface 132. The flexible film substrate 130 may be similar to the flexible film substrate 30 (shown in FIG. 1). The flexible film substrate 130 has a signal element 136 and a ground element 138 on the first surface 132. The flexible film substrate 130 may be configured to flex during its normal use, such as by folding or bending the flexible film substrate 130 to fit within a particular space or area of the electronic device 14.

The antenna 112 includes a signal contact 140 and ground contact 142. The signal contact 140 is mounted to the flexible film substrate 130 and is electrically connected to the signal element 136. The ground contact 142 is mounted to the flexible film substrate 130 and is electrically connected to the ground element 138. In an exemplary embodiment, the signal contact 140 and ground contact 142 are mounted to the flexible film substrate 130 without the use of solder or epoxy. The signal contact 140 and ground contact 142 are mechanically connected to the flexible film substrate 130. The signal contact 140 and ground contact 142 may be connected to the signal element 136 and ground element 138, respectively, by compression connections, wherein the signal and ground contacts 140, 142 are pressed against the signal and ground elements 136, 138 in direct electrical contact with the signal and ground elements 136, 138, respectively.

The signal contact 140 includes a base 150 and mounting elements 152 used to secure the signal contact 140 to the flexible film substrate 130. The base 150 is electrically connected to the signal element 136. The mounting elements 152 may be similar to the mounting elements 52 (shown in FIG. 1). The mounting elements 152 mechanically secure the signal contact 140 to the flexible film substrate 130. For example, the mounting elements 152 may pierce through the flexible film substrate 130 and wrap around the second surface 134 of the flexible film substrate 130. The mounting elements 152 may constitute barbs that are configured to pierce through the flexible film substrate 130. Other types of mechanical fastening means or processes may be used in other embodiments to mechanically secure the signal contact 140 to the flexible film substrate 130.

The signal contact 140 includes a wire termination 154 extending from the base 150. The wire termination 154 is configured to be terminated to the center conductor 126 of the cable 116. In the illustrated embodiment, the wire termination 154 constitutes an insulation displacement type connection where the center conductor 126 and dielectric 124 are loaded between barbs 156 that pierce or cut through the dielectric 124 to mechanically and electrically engage the center conductor 126. In the illustrated embodiment, the wire termination 154 includes two sets of barbs 156 spaced apart from one another. The barbs 156 mechanically and electrically connect to two different areas of the center conductor 126 for increased stability and connection. The barbs 156 may be provided at opposite ends of the base 150. Other types of wire terminations are possible in alternative embodiments, including crimp type terminations. The signal contact 140 extends along a longitudinal axis 158, which is parallel to the signal element 136.

The ground contact 142 includes a base 160 and mounting elements 162 used to secure the ground contact 142 to the flexible film substrate 130. The base 160 is electrically connected to the ground element 138. In an exemplary embodiment, as will be described in further detail below, the mounting elements 162 mechanically secure the ground contact 142 to the flexible film substrate 130. For example, the mounting elements 162 may pierce through the flexible film substrate 130 and wrap around the second surface 134 of the flexible film substrate 130. Other types of mechanical fastening means or processes may be used in other embodiments to mechanically secure the ground contact 142 to the flexible film substrate 130.

The ground contact 142 includes a wire termination 164 extending from the base 160. The wire termination 164 is configured to be terminated to the cable braid 122 of the cable 116. In the illustrated embodiment, the wire termination 164 constitutes an insulation displacement type connection where the jacket 120 and cable braid 122 are loaded between barbs 166 that pierce or cut through the jacket 120 to mechanically and electrically engage the cable braid 122. In the illustrated embodiment, the wire termination 164 includes two sets of barbs 166 spaced apart from one another. The barbs 166 mechanically and electrically connect to two different areas of the cable braid 122 for increased stability and connection. The barbs 166 may be provided at opposite ends of the base 160. Other types of wire terminations are possible in alternative embodiments, including crimp type terminations. The ground contact 142 extends along a longitudinal axis 168, which is parallel to the ground element 138.

The ground contact 142 includes a strain relief element 170 configured to engage the jacket 120 of the cable 116. In the illustrated embodiment, the strain relief element 170 represents an interference type connection for holding the jacket 120. Other types of strain relief elements may be used in alternative embodiments to engage the jacket 120 and provide strain relief for the cable 116, such as a crimp connection. The strain relief element 170 helps to maintain a relative position of the cable 116 with respect to the signal and ground contacts 140, 142.

The strain relief element 170 includes a first spring beam 172 and a second spring beam 174. The first and second spring beams 172, 174 extend from opposite sides of the base 160 and face in opposite directions. The first and second spring beams 172, 174 are curled inward toward the cable 116. Distal ends 176, 178 of the first and second spring beams 172, 174 engage the jacket 120 to hold the jacket 120 in place relative to the base 160. The first and second spring beams 172, 174 define receiving spaces 180, 182, respectively, that receive the cable 116. The first and second spring beams 172, 174 are curved around the receiving spaces 180, 182. The receiving spaces 180, 182 are sized to receive a range of different gauge cables 116. When the cable 116 is loaded into the receiving spaces 180, 182, the first and second spring beams 172, 174 may be at least partially deflected outward, causing an inward spring bias toward the cable 116. The first and second spring beams 172, 174 thus hold the cable 116 by an interference engagement. While two spring beams 172, 174 are illustrated in FIG. 5, any number of spring beams may be provided in alternative embodiments. Additionally, the spring beams 170, 172 may extend from the same side of the base 160 in an alternative embodiment.

Having the wire termination 164 engage the cable 116 at both ends of the base 160 allows the ground contact 142 to be electrically commoned with the cable braid 122 for a longer portion of the cable 116 than if the wire termination 164 only engaged the cable 116 at one position along the length of the cable 116. The strain relief element 170 is positioned between the two sets of barbs 166 such that the wire termination 164 is terminated to the cable 116 on both sides of the strain relief element 170. Having the strain relief element 170 positioned between the two sets of barbs 166 shortens the overall length of the ground contact 142, as compared to a ground contact in which the strain relief element 170 is positioned rearward of the rear set of barbs 166. Having the strain relief element 170 positioned between the two sets of barbs 166 additionally provides mechanical retention of the jacket 120 with respect to the wire termination 154.

During assembly, the mounting elements 152 are loaded through the flexible film substrate 130, and the signal contact 140 is pressed down on to the flexible film substrate 130 until the base 150 engages the signal element 136. The mounting elements 152 may have points at distal ends thereof that allow the mounting elements 152 to pierce the flexible film substrate 130. Alternatively, the flexible film substrate 130 may have slots or openings formed therethrough that receive the mounting elements 152. When loaded onto the flexible film substrate 130, the mounting elements 152 are configured to engage the second surface 134 of the flexible film substrate 130. The engagement of the mounting elements 152 to the second surface 134 retains the signal contact 140 on the flexible film substrate 130. In an exemplary embodiment, the mounting elements 152 may be folded or wrapped underneath the signal element 136 along the second surface 134. For example, the mounting elements 152 may be bent inward, such as in a manner similar to a staple, to secure the signal contact 140 to the flexible film substrate 130. The mounting elements 162 may be substantially similar to the mounting elements 152 and may be secured to the flexible film substrate 130 in a similar manner.

Wrapping the mounting elements 152, 162 under the second surface 134 forces the mounting elements 152, 162 against the second surface 134. Wrapping the mounting elements 152, 162 under the second surface 134 may force the corresponding bases 150, 160 against the first surface 132 and the signal and ground elements 136, 138, respectively. The mounting elements 152, 162 may also force the flexible film substrate 130 against the bases 150, 160 which may cause the signal element 136 and the ground element 138 to be pressed against the bases 150, 160 of the signal contact 140 and the ground contact 142, respectively. In an exemplary embodiment, the flexible film substrate 130 may be at least partially compressed between the mounting elements 152, 162 and the bases 150, 160, respectively.

Pressing the mounting elements 152 against the second surface 134 of the flexible film substrate 130 generally compresses the signal element 136 against the signal contact 140. For example, the signal element 136 is pressed against the base 150 to ensure good electrical contact between the base 150 and the signal element 136. When assembled, the flexible film substrate 130 is captured between the base 150 and the mounting elements 152. The flexible film substrate 130 may be at least partially deflected or flexed inward when the mounting elements 152 are pressed closed. As such, a direct electrical connection is provided between the signal contact 140 and signal element 136, without the need for solder or epoxy. The signal contact 140 is mechanically self-secured to the flexible film substrate 130. No additional element or component is needed to make electrical or mechanical connection between the signal contact 140 and the signal element 136.

Pressing the mounting elements 162 against the second surface 134 of the flexible film substrate 130 generally compresses the ground element 138 against the ground contact 142. For example, the ground element 138 is pressed against the base 160 to ensure good electrical contact between the base 160 and the ground element 138. When assembled, the flexible film substrate 130 is captured between the base 160 and the mounting elements 162. The flexible film substrate 130 may be at least partially deflected or flexed inward when the mounting elements 162 are pressed closed. As such, a direct electrical connection is provided between the ground contact 142 and ground element 138, without the need for solder or epoxy. The ground contact 142 is mechanically self-secured to the flexible film substrate 130. No additional element or component is needed to make electrical or mechanical connection between the ground contact 142 and ground element 138.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An antenna comprising:

a flexible film substrate having a signal element and a ground element;

a signal contact mounted to the flexible film substrate, the signal contact being electrically connected to the signal element by a compression connection, the signal contact having a wire termination configured to be terminated to a center conductor of a coaxial cable; and a ground contact mounted to the flexible film substrate, the ground contact being electrically connected to the ground element by a compression connection, the ground contact having a wire termination configured to be terminated to a cable braid of the coaxial cable.

2. The antenna of claim 1, wherein the signal contact wraps around the signal element of the flexible film substrate such that a portion of the signal contact is positioned above the signal element and a portion of the signal contact is positioned below the signal element.

3. The antenna of claim 1, wherein the signal contact includes a mounting element extending from a base, the base being electrically connected to the signal element, the mounting element engaging the flexible film substrate such that the flexible film substrate is captured between the mounting element and the base of the signal contact.

4. The antenna of claim 1, wherein the signal contact includes a base mounted to the flexible film substrate in electrical connection with the signal element, the signal contact having a mounting element extending from the base, the mounting element being folded under the flexible film substrate to compress the flexible film substrate between the mounting element and the base.

5. The antenna of claim 1, wherein the signal contact includes a base mounted to the flexible film substrate in electrical connection with the signal element, the signal contact having a mounting element piercing the flexible film substrate to mechanically secure the signal contact to the flexible film substrate.

6. The antenna of claim 1, wherein the signal contact is mechanically secured to the'flexible film substrate using mounting elements integrally formed with the signal contact.

7. The antenna of claim 1, wherein the signal contact is electrically connected to the signal element of the flexible film substrate in a solderless connection.

8. The antenna of claim 1, wherein the wire termination of the signal contact constitutes a crimp termination to the center conductor of the coaxial cable.

9. The antenna of claim 1, wherein the wire termination of the signal contact constitutes an insulation displacement termination to the center conductor of the coaxial cable.

10. The antenna of claim 1, wherein the flexible film substrate includes a first surface and a second surface, the signal element and the ground element being provided on the first surface, the signal contact having a base and a mounting element extending from the base, the base being flattened against the first surface, the mounting element being flattened against the second surface.

11. The antenna of claim 1, wherein the signal contact directly engages the signal element, and wherein the ground contact directly engages the ground element.

12. The antenna of claim 1, wherein the ground contact extends between a first end and a second end, the ground contact having a first wire termination proximate to the first end and a second wire termination proximate to the second end, the ground contact having a strain relief element configured to engage the coaxial cable, the strain relief element being positioned between the first wire termination and the second wire termination.

13. The antenna of claim 1, wherein the flexible film substrate includes an opening therethrough, the wire termination of the signal contact being aligned above the opening, the wire termination of the ground contact being aligned above the opening.

14. An antenna comprising:

a flexible film substrate having first and second surfaces, the flexible film substrate having a signal element and a ground element on the first surface;

a signal contact having a base mounted to the first surface of the flexible film substrate in electrical connection with the signal element, the signal contact having a mounting element extending from the base, the mounting element engaging the second surface such that the flexible film substrate is captured between the mounting element and the base of the signal contact, the signal contact having a wire termination configured to be terminated to a center conductor of a coaxial cable; and a ground contact having a base mounted to the first surface of the flexible film substrate in electrical connection with the ground element, the ground contact having a mounting element extending from the base, the mounting element engaging the second surface such that the flexible film substrate is captured between the mounting element and the base of the ground contact, the ground contact having a wire termination configured to be terminated to a cable braid of the coaxial cable.

15. The antenna of claim 14, wherein the mounting element of the signal contact engages the flexible film substrate such that the flexible film substrate is captured between the mounting element and the base of the signal contact, and wherein the mounting element of the ground contact engages the flexible film substrate such that the flexible film substrate is captured between the mounting element and the base of the ground contact.

16. The antenna of claim 14, wherein the mounting element of the signal contact is folded under the flexible film substrate to compress the flexible film substrate between the mounting element and the base of the signal contact, and wherein the mounting element of the ground contact is folded under the flexible film substrate to compress the flexible film substrate between the mounting element and the base of the ground contact.

17. The antenna of claim 14, wherein the mounting element of the signal contact pierces through the flexible film substrate to mechanically secure the signal contact to the flexible film substrate, and wherein the mounting element of the ground contact pierces through the flexible film substrate to mechanically secure the ground contact to the flexible film substrate.

18. A wireless communication system comprising:

a coaxial cable having a center conductor, a dielectric surrounding the center conductor, a cable braid surrounding the dielectric and a jacket surrounding the cable braid; and an antenna comprising:

a flexible film substrate having a signal element and a ground element;

a signal contact mounted to the flexible film substrate, the signal contact being electrically connected to the signal element by a compression connection, the signal contact having a wire termination configured to be terminated to a center conductor of a coaxial cable; and a ground contact mounted to the flexible film substrate, the ground contact being electrically connected to the ground element by a compression connection, the ground contact having a wire termination configured to be terminated to a cable braid of the coaxial cable.

19. The wireless communication system of claim 18, wherein the signal contact includes a mounting element extending from a base, the base being electrically connected to the signal element, the mounting element engaging the flexible film substrate such that the flexible film substrate is captured between the mounting element and the base of the signal contact.

20. The wireless communication system of claim 18, wherein the signal contact includes a base mounted to the flexible film substrate in electrical connection with the signal element, the signal contact having a mounting element extending from the base, the mounting element being folded under the flexible film substrate to compress the flexible film substrate between the mounting element and the base.

* * * * *